US007415768B2

(12) United States Patent
Bader et al.

(10) Patent No.: US 7,415,768 B2
(45) Date of Patent: Aug. 26, 2008

(54) SHEAR SYSTEM FOR AN ELECTRIC HAIR REMOVING APPARATUS

(75) Inventors: Raoul Bader, Bischofsheim (DE); Luis Burrel, Frankfurt am Main (DE); Werner Dalitz, Bad Nauheim (DE); Andreas Moehring, Kronberg (DE); Martin Kluge, Hattersheim (DE); Andre Nauber, Frankfurt (DE); Uwe Schaaf, Alsbach-Hahnlein (DE)

(73) Assignee: Braum GmbH, Kronberg (DE)

( * ) Notice: Subject to any disclaimer, the term of this patent is extended or adjusted under 35 U.S.C. 154(b) by 26 days.

(21) Appl. No.: 11/388,500

(22) Filed: Mar. 24, 2006

(65) Prior Publication Data

US 2006/0225290 A1 Oct. 12, 2006

Related U.S. Application Data

(63) Continuation of application No. PCT/EP2004/009824, filed on Sep. 3, 2004.

(30) Foreign Application Priority Data

Sep. 25, 2003 (DE) ..... 103 44 566

(51) Int. Cl.
*B26B 19/42* (2006.01)

(52) U.S. Cl. ..... 30/34.2; 30/43.92; 30/346.51

(58) Field of Classification Search ..... 30/34.2, 30/43.92, 346.51, 43.9, 34.1
See application file for complete search history.

(56) References Cited

U.S. PATENT DOCUMENTS

| | | | | | |
|---|---|---|---|---|---|
| 2,143,896 | A | * | 1/1939 | Nyhagen | 30/34.2 |
| RE21,192 | E | * | 8/1939 | Stein | 30/34.2 |
| 2,279,102 | A | * | 4/1942 | Altemus | 30/43.92 |
| 2,282,748 | A | * | 5/1942 | Rand, Jr. et al. | 30/43.92 |
| 2,300,140 | A | * | 10/1942 | Berg et al. | 30/43.2 |
| 2,317,177 | A | * | 4/1943 | Carissimi | 30/34.2 |
| 2,335,413 | A | * | 11/1943 | Hicks | 30/43.1 |
| 2,568,047 | A | | 9/1951 | Anderson | 30/34.2 |
| 3,290,775 | A | * | 12/1966 | Tolmie | 30/34.2 |
| 3,834,017 | A | * | 9/1974 | Tolmie | 30/34.2 |
| 3,945,115 | A | * | 3/1976 | Daniels et al. | 30/34.2 |
| 3,962,784 | A | | 6/1976 | Tietjens | 30/43.6 |
| 4,614,036 | A | | 9/1986 | Haraguchi | 30/200 |
| 4,635,360 | A | | 1/1987 | Tanahashi et al. | 30/34.2 |
| 5,050,304 | A | | 9/1991 | Fujikawa et al. | 30/196 |
| 5,669,138 | A | | 9/1997 | Wetzel | 30/43.92 |
| 5,706,582 | A | | 1/1998 | Hosokawa et al. | 30/34.2 |
| 5,964,034 | A | | 10/1999 | Sueyoshi et al. | 30/34.2 |
| 5,979,060 | A | | 11/1999 | Holzbauer et al. | 30/201 |

(Continued)

FOREIGN PATENT DOCUMENTS

| | | |
|---|---|---|
| CA | 1 134 706 | 11/1982 |

(Continued)

*Primary Examiner*—Hwei-Siu C. Payer
(74) *Attorney, Agent, or Firm*—Fish & Richadson P.C.

(57) ABSTRACT

The invention is directed to a shear system for an electric hair removing apparatus, in particular for an electric shaving apparatus, including at least one shearing unit having an outer cutter and an undercutter that are set in relative motion. The shear system of the invention includes at least one feeding device arranged to precede the shearing unit and is characterized in that the feeding device is set in motion relative to the outer cutter.

15 Claims, 4 Drawing Sheets

U.S. PATENT DOCUMENTS

| | | | | |
|---|---|---|---|---|
| 6,308,414 | B1 * | 10/2001 | Parsonage et al. | 30/43.91 |
| 6,684,509 | B1 * | 2/2004 | Best et al. | 30/43.92 |

FOREIGN PATENT DOCUMENTS

| | | |
|---|---|---|
| DE | 959 167 | 2/1957 |
| DE | 1 069 499 | 5/1960 |
| DE | 292502 | 8/1971 |
| DE | 25 13 017 | 10/1975 |
| DE | 34 41 060 | 6/1985 |
| DE | 35 18 455 | 11/1985 |
| DE | 39 41 660 | 6/1990 |
| DE | 196 06 638 | 8/1996 |
| DE | 196 29 337 | 1/1998 |
| DE | 198 22 094 | 11/1999 |
| DE | 198 32 475 | 3/2000 |
| DE | 197 27 095 | 8/2000 |
| EP | 0 855 256 | 8/1999 |
| GB | 1124394 | 8/1968 |
| JP | 10323463 | 12/1998 |
| WO | WO99/59781 | 11/1999 |
| WO | WO01/47671 | 7/2001 |

* cited by examiner

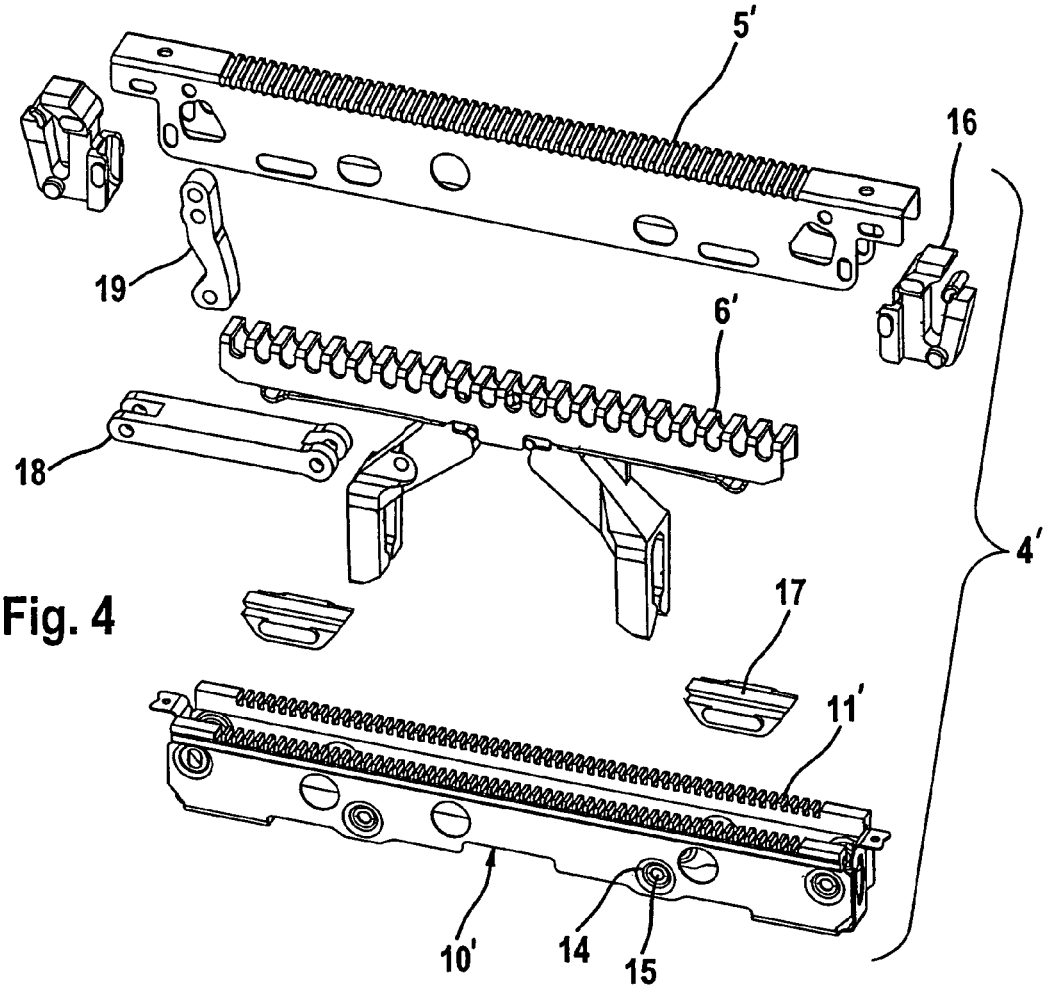
Fig. 4
Fig. 5
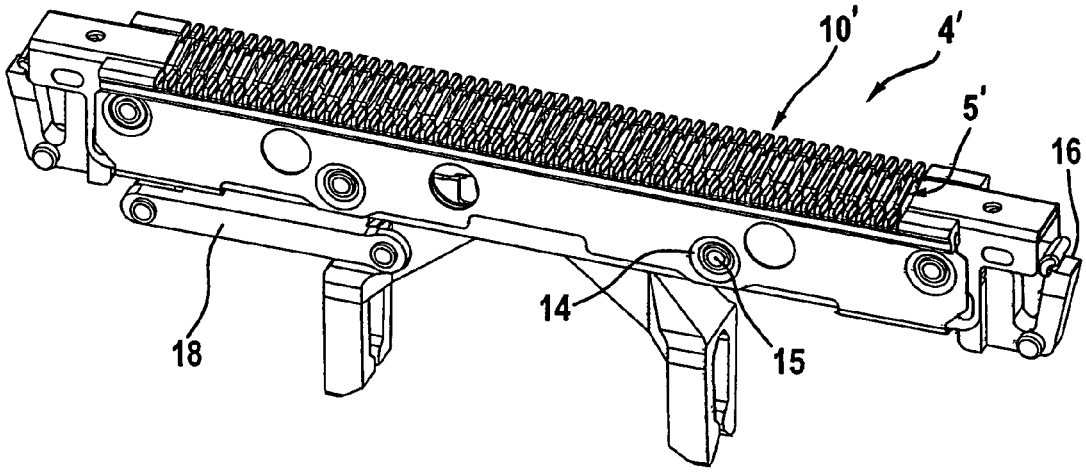

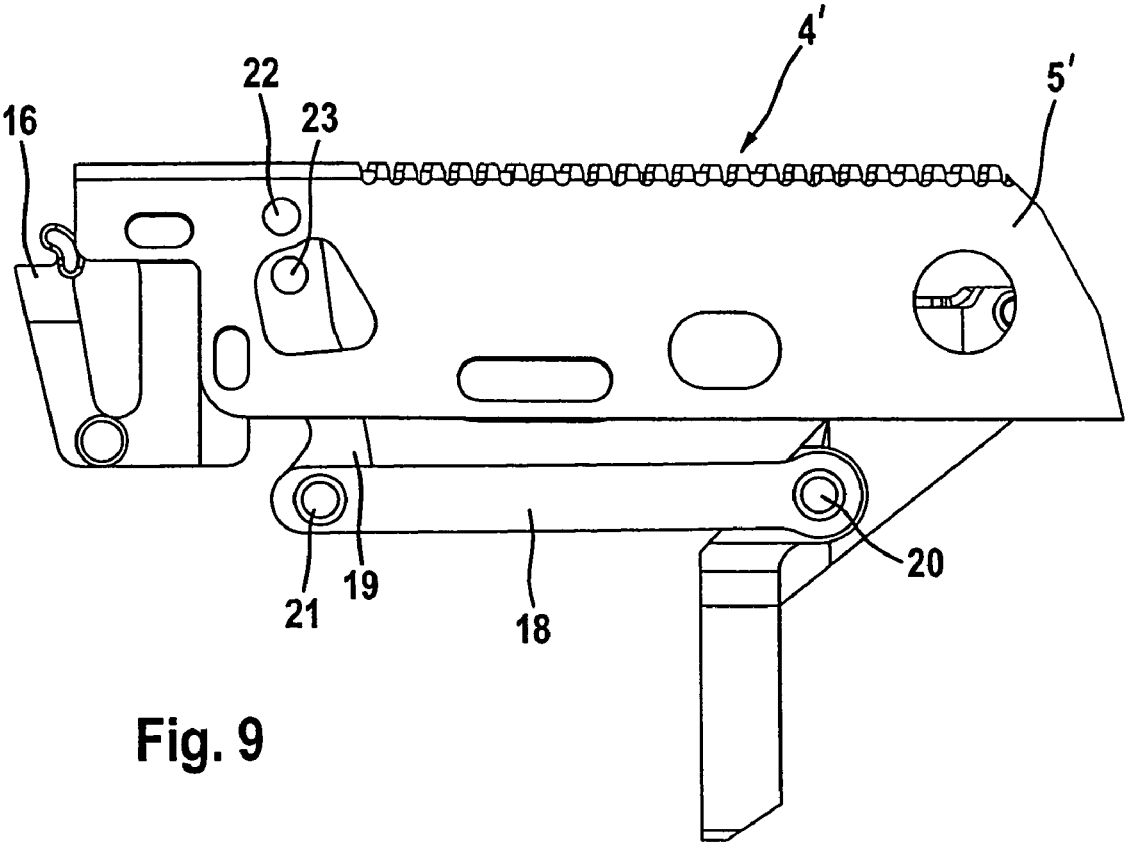
Fig. 9
Fig. 10
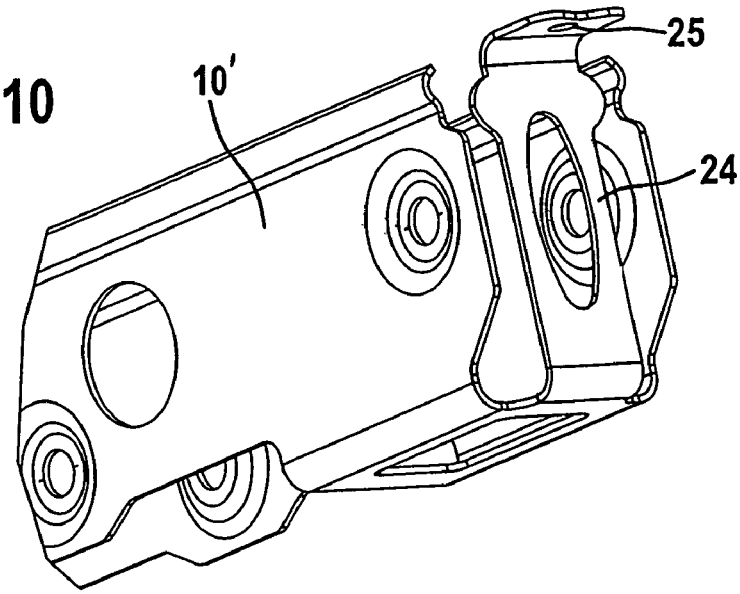

SHEAR SYSTEM FOR AN ELECTRIC HAIR REMOVING APPARATUS

CROSS-REFERENCE TO RELATED APPLICATIONS

This is continuation of PCT application No. PCT/EP2004009824, filed on Sep. 3, 2004, which claims priority to German Patent Application No. 103 44 566.8, filed on Sep. 25, 2003.

TECHNICAL FIELD

This invention relates to a shear system for an electric hair removing apparatus, in particular for an electric shaving apparatus. The invention relates further to a hair removing apparatus, in particular an electric shaving apparatus, comprising such a shear system.

BACKGROUND

Shear systems are employed in a wide variety of electric shaving devices. In constructing shear systems, considerable effort is sometimes expended to obtain a shave as thorough as possible. One difficulty presenting itself in this connection is the reliable removal of hairs lying flat against the skin, and the art knows of shear systems which are equipped with structural elements specifically developed for this purpose.

In this context it is known from Canadian Pat. No. CA 1 134 706 to provide an electric shaving apparatus with a raking device that is arranged centrally between two laterally spaced cutting regions of a pre-cutter. The pre-cutter includes a stationary outer cutter and a movable inner cutter. The raking device is secured to the stationary outer cutter and has teeth protruding beyond this cutter. The raking device serves to lift ingrown hairs, making them accessible for the cutting operation.

Furthermore, from DE 959 167 C there is known an electric shaving apparatus having at least one shaving head. The shaving head includes a movable cutter that is covered by a perforate guard plate. Fixedly arranged on either side of the guard plate, ahead of entrance slits in the guard plate, are small brushes whose tips protrude beyond the plane of the guard plate. The brushes are intended to facilitate the penetration of the hairs into the perforations of the guard plate.

JP 10-323463 discloses a shaving system for an electric shaving apparatus which includes a stationary cutter and a movable cutter. The stationary cutter is U-shaped in cross-section and has a plurality of slits. The movable cutter is in sliding engagement with the undersurface of the stationary cutter. Disposed in an intermediate space in the stationary cutter is a comb that is fixedly connected to the stationary cutter and of a height smaller than the upper side of the stationary cutter. The comb is intended to lift low-lying hairs and feed them to the slits of the stationary cutter.

A shaving head for a blade-type razor is known from EP 0 855 256 B1. The shaving head has a blade for severing hair close to the skin. The shaving head further includes a manipulator that moves the hair during the act of cutting longitudinally of the blade and relative to the skin. To this effect, the manipulator is driven by a drive system and has teeth and recesses therebetween.

U.S. Pat. No. 2,568,047 discloses a blade-type razor having guard rollers adjacent to the blade on either side thereof. The guard rollers are provided with circumferentially extending ribs and grooves and are caused to rotate by contact with the skin during cutting strokes of the razor. The rotating guard rollers urge the skin and the beard bristles toward the cutting edge of the blade, thereby promoting a clean cut.

SUMMARY

It is an object of the present invention to provide a shear system for an electric hair removing apparatus such as to enable it to remove hair as thoroughly as possible and with minimum irritation to the user's skin.

In one aspect, the invention features a shear system for an electric hair removing apparatus, e.g., an electric shaving apparatus, which includes at least one shearing unit having an outer cutter and an undercutter that are set in relative motion. The shear system further includes at least one feeding device arranged to precede the shearing unit, the feeding device being configured to be set in motion relative to the outer cutter.

Preferred shear systems are highly effective in the removal of hair. In particular, long hair and/or hair resting flat against the skin are captured and removed by the preferred shear systems with a comparatively high degree of probability. Preferred shear systems generally enable a very short cut, meaning that the hair is severed very close to the skin surface.

The feeding device may include plural feeding elements arranged in correlation with the geometry of the outer cutter. These feeding elements are comprised of a plastics material preferably at least in a region provided for contact with the skin. This has the advantage of ensuring a very gentle treatment of the skin.

The feeding elements of the feeding device may be located laterally adjacent to the shearing unit. In this arrangement it is particularly advantageous for the feeding device to be in abutting engagement with the shearing unit laterally only in some areas. A small area of contact between the feeding device and the shearing unit enables friction to be maintained at a low level so that the additional power consumption for the drive unit of the feeding device is comparatively low.

The outer cutter may include bars and cutting apertures succeeding each other in alternation, with the feeding elements of the feeding device being arranged to precede the respective bars. This may have the advantage of enabling hair from the bar area to be fed to the cutting apertures by means of the feeding elements and to be likewise severed. The bars are in particular shaped in such manner that the cutting apertures widen from the side of the outer cutter where the undercutter is arranged toward the environment. This shaping facilitates the process of threadedly engaging the hairs with the cutting apertures. Furthermore it is advantageous for the bars to enclose an angle with a cutting edge of the undercutter. This enables edge-on-edge impact between the undercutter and the outer cutter to be avoided in addition to having a beneficial effect on the threading efficiency.

In a preferred embodiment the feeding device is moved parallel to a direction in which the bars and cutting apertures of the outer cutter succeed each other. In this arrangement the feeding device is preferably caused to perform an oscillatory motion. The frequency of the oscillatory motion of the feeding device may correspond in particular to the frequency of the relative motion between the outer cutter and the undercutter. The amplitude is preferably selected smaller than the amplitude of the relative motion between the outer cutter and the undercutter. Such a movement can be generated without major effort and allows an effective feeding of the hairs to the cutting apertures. Moreover, this motion is comparatively kind to the skin. To produce the motion provision may be made for a coupling mechanism to transmit the relative motion between the outer cutter and the undercutter to the feeding device.

The feeding device may be constructed in particular in the form of a comb having its teeth oriented essentially normal to a plane provided in the shearing unit for contact with the skin. In this arrangement the free ends of the teeth may reach as far as to the plane provided for skin contact.

The present invention further relates to electrical hair removing devices, in particular electric shaving devices, that include a shear system constructed in accordance with the invention.

The details of one or more embodiments of the invention are set forth in the accompanying drawings and the description below. Other features and advantages of the invention will be apparent from the description and drawings, and from the claims.

DESCRIPTION OF DRAWINGS

FIG. 4 is an exploded perspective view of an alternative pre-cutter;

FIG. 5 is a perspective view of the components of the pre-cutter shown in FIG. 4 in assembled condition;

FIG. 9 is a side view of the pre-cutter shown in FIG. 4; and

FIG. 10 is a perspective view an area at one of the narrow ends of the feeding comb shown in FIG. 4.

Like reference symbols in the various drawings indicate like elements.

DETAILED DESCRIPTION

Figure 1:
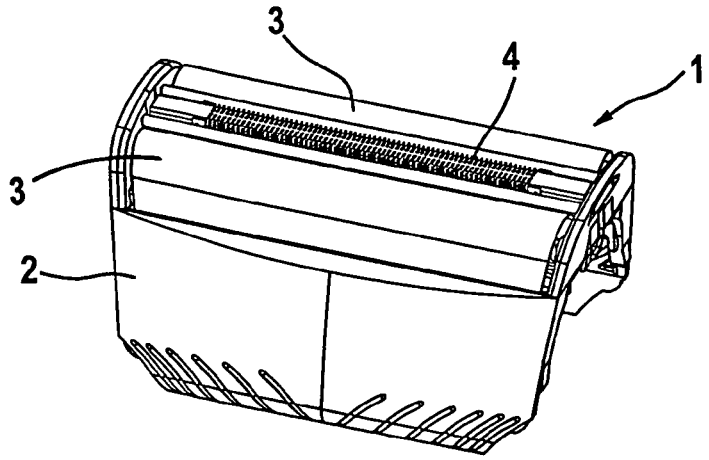
FIG. 1 is a perspective view of a shaving head of an electric shaving apparatus including a pre-cutter.
Figure 2:
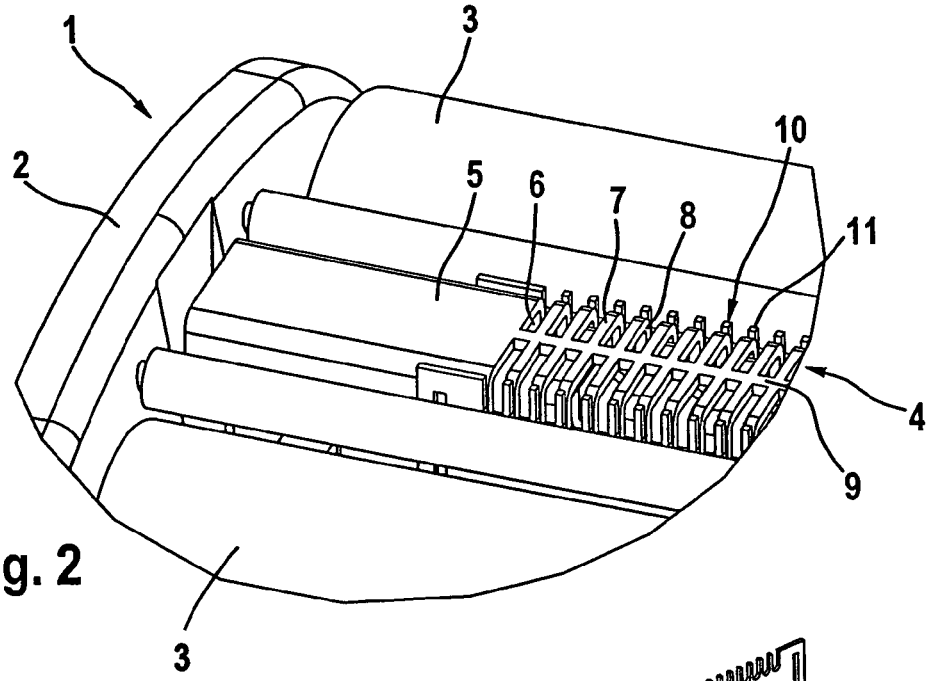
FIG. 2 is an enlarged fragmentary view of FIG. 1.

FIG. 1 shows a shaving head 1. An enlarged detail of FIG. 1 is shown in FIG. 2. The shaving head 1 has a casing part 2 and two shaving foils 3 arranged in spaced relation to each other. Interposed between the shaving foils 3 is a pre-cutter 4. The pre-cutter 4 serves to shorten comparatively long hairs and/or hairs lying flat against the skin so as to enable them to enter readily the perforations in the shaving foils 3. To accomplish this, the pre-cutter 4 is provided with a cutting comb 5 and a cutting blade 6 disposed within the cutting comb 5. The cutting comb 5 has a plurality of U-shaped parallel bars 7 separated from each other by intermediate slits 8 for entry of the hairs. A center bar 9 connects the bars 7 in the middle of the cutting comb 5. The cutting blade 6 performs an oscillatory linear motion relative to the cutting comb 5 in a direction transverse to the bars 7 of the cutting comb 5. This motion severs the hairs threaded into the slits 8 of the cutting comb 5. Provided on either side adjacent to the cutting comb 5, that is, between the cutting comb 5 and the two adjacent shaving foils 3, is a respective feeding comb 10.

Figure 3:
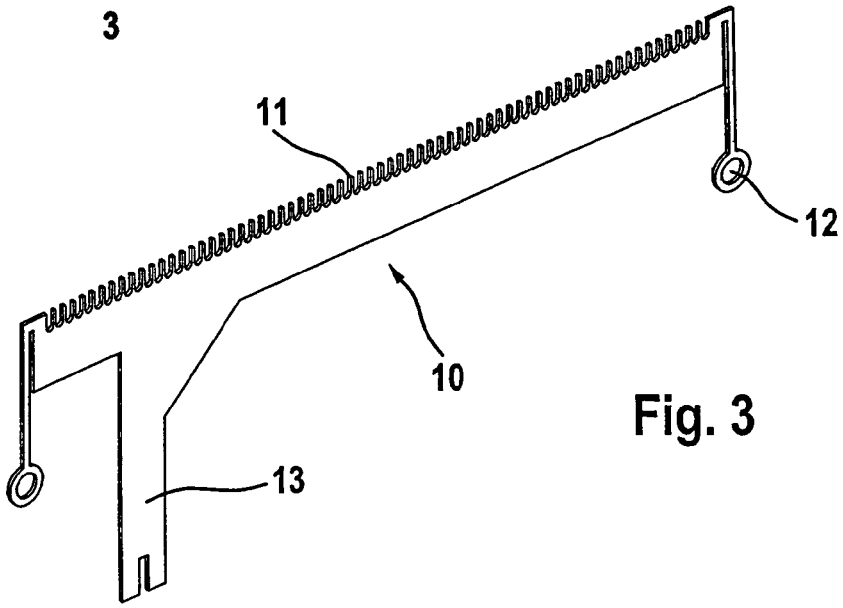
FIG. 3 is a perspective view of a feeding comb used in the pre-cutter shown in FIG. 1.

The shape of the feeding comb 10 is shown in detail in FIG. 3. The feeding comb 10 has a plurality of teeth 11 extending parallel to each other. The feeding comb further has two holes 12 for receiving screws or other fasteners and an extension 13 for coupling to a drive element.

As is apparent from FIG. 2, the teeth 11 of the feeding combs 10, in assembled condition, extend essentially normal to the back of the cutting comb 5 which is in contact with the skin during the act of shaving. In consequence, the teeth 11 of the feeding combs 10 extend essentially normal to the skin surface during shaving. In addition, the arrangement of the teeth 11 of the feeding combs 10 correlates with the geometry of the cutting comb 5. In the pre-cutter 4 shown in FIG. 2, the correlation is designed so that a respective tooth 11 of each feeding comb 10 is located ahead of each bar 7 of the cutting comb 5 on either side thereof. It is thereby possible to move hairs out of the region in front of the bars 7 of the cutting comb 5 and to facilitate the threading of the hairs into the slits 8. Hair is fed from the bar region to the slits 8 in a particularly effective way by setting the feeding combs 10 in an oscillatory linear motion parallel to their longitudinal dimension. The amplitude selected for this oscillatory motion is preferably smaller than the amplitude of the cutting blade 6, and a selected frequency is higher than about 50 Hz. The oscillatory motion of the feeding combs 10 can be generated by coupling them to the drive unit of the cutting blade 6. In this arrangement, the amplitude of the oscillatory motion of the feeding combs 10 can be adjusted through the position of the coupling point. The oscillatory motion causes the hairs captured by the feeding combs 10 to be moved out of their current position. Furthermore, a torque is exerted on the hairs which, in evading this torque, increase their angle to the skin surface. Hence, the oscillatory motion of the feeding combs 10 has the added effect of lifting the hairs.

Due to the active feeding of the hairs to the slits 8 of the cutting comb 5 using the oscillatory feeding combs 10, the slits 8 can be designed to narrower dimensions as compared to systems having no oscillatory feeding combs 10. This again opens up the possibility of fabricating the cutting comb 5 from a thinner material and thereby cutting the hairs to a shorter length while its stability is maintained unchanged. In this manner a cutting length of less than 0.2 mm is generally accomplishable with the use of the pre-cutter 4. Such a short cutting length enables the geometry of the shaving foils 3 to be simplified.

FIGS. 4 and 5 show a pre-cutter 4', including a feeding comb 10', according to an alterative implementation. In this implementation, the cutting comb 5' is surrounded on either side by the feeding comb 10', which has a U-shaped cross-section. Feeding comb 10' performs an oscillatory linear motion and transmits this motion to skin and hairs in its surroundings during the act of shaving. The feeding comb 10' does not have its entire lateral surface in abutment with the cutting comb 5', but only the area of four circular embossments 14. As a result, the friction between the feeding comb 10' and the cutting comb 5' can be maintained relatively low. Formed within the embossments 14 are openings 15 for the passage of drive or mounting axles. The axles have a stabilizing effect on the U-shaped configuration of the feeding comb 10'. The axles can be fixed in place axially by washers which may be disposed in the embossments 14, hence having no additional space requirements. Further design differences of the feeding combs 10 and 10' will be discussed in greater detail below. FIGS. 4 and 5 show as further components two end sections 16 of the cutting comb 5', two supports 17 for the cutting blade 6', a driving lever 18 and a transmission lever 19.

Figure 6:
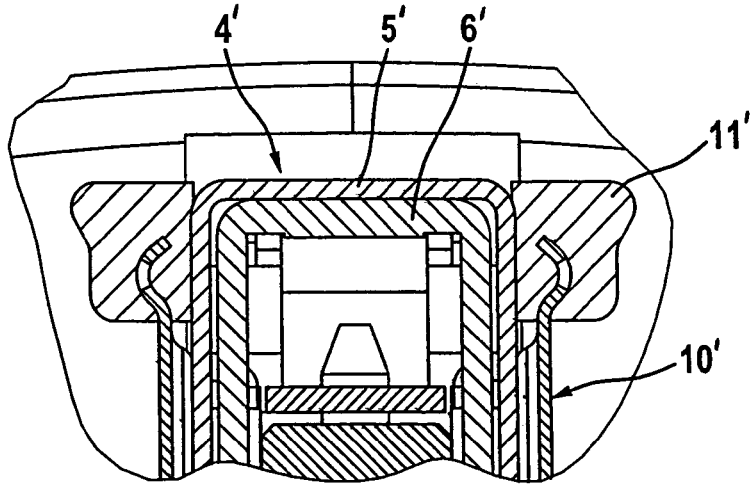
FIG. 6 is fragmentary cross-sectional view of a shaving head including the pre-cutter shown in FIG. 4.

As shown in FIGS. 4 and 6, the feeding comb 10' has relatively thick, rounded teeth 11. A typical dimension of a tooth 11' perpendicular to the longitudinal dimension of the feeding comb 10' is 1 mm. The dimension of the teeth 11' perpendicular to the plane of the skin is about 1.1 mm. The teeth 11' are injection-molded from plastics, for example, from POM, and are arranged in an end region, hook-shaped in cross-section, of the feeding comb 10'. In this arrangement, the teeth 11' are not completely rigidly disposed in the longitudinal direction of the feeding comb 10' but are slightly displaceable relative to the feeding comb 10' in order to prevent distortion of the feeding comb 10'. This design of the teeth 11' enables a particularly skin-friendly shave to be accomplished. As in the pre-cutter 4 discussed above, the teeth 11' are again arranged to precede the bars 7' of the cutting comb 5'. The cutting comb 5' is preferably fabricated from a relatively thin material, for example about 0.13 mm thick. By reason of the bending process used in manufacture, the outer edges of the cutting comb 5' have no sharp edges, being instead rounded with a radius of between 0.3 and 0.45 mm. Further details regarding the formation of the cutting comb 5' will be explained with reference to FIGS. 7 and 8.

Figure 7:
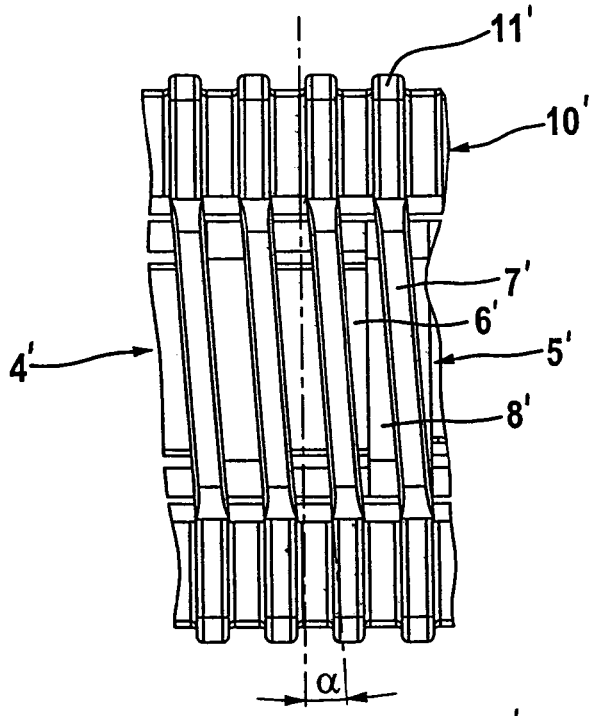
FIG. 7 is a fragmentary top plan view of the pre-cutter shown in FIG. 4.

As becomes apparent from FIG. 7, in contrast to the cutting comb 5, the cutting comb 5' has no center bar 9', so the slits 8' extend across the full width of the cutting comb 5'. This facilitates in particular the threading in of long hairs. Furthermore, the bars 7' of the cutting comb 5' do not extend parallel to the cutting blade 6' but include with the cutting blade 6' an angle $\alpha$ of 4 degrees, for example. With the pre-cutter 4' in operation, this prevents the occurrence of an edge-on-edge impact between the cutting blade 6' and the cutting comb 5'. The angle $\alpha$ and the geometry of the cutting comb 5' and the feeding comb 10' are coordinated such that the teeth 11' of the feeding comb 10' are located ahead of the respective bars 7' on either side of the cutting comb 5', in spite of the offset of the bars 7' of the cutting comb 5'.

Figure 8:
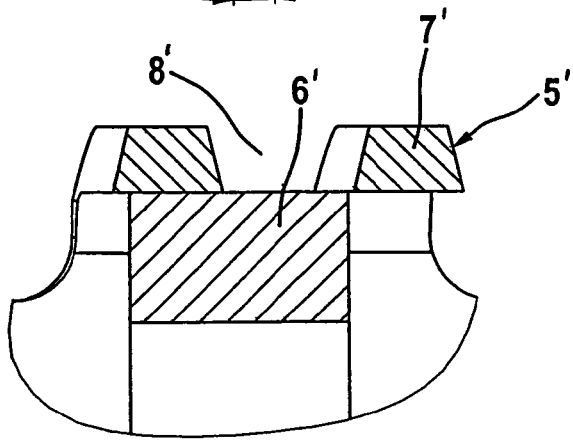
FIG. 8 is a fragmentary longitudinal sectional view of the pre-cutter shown in FIG. 4.

FIG. 8 shows the pre-cutter 4' in a fragmentary longitudinal sectional view. The fragment shown includes a part area of the cutting comb 5' and of the cutting blade 6' disposed underneath. The slits 8' in the cutting comb 5' widen from the side of abutment with the cutting blade 6' toward the side engaging with the skin during the act of shaving. With a thickness of the bars 7' of the cutting comb 5' of 0.13 mm and a width of the bars of 0.25 mm on the side close to the cutting blade 6', the width of the slits 8' on the side close to the skin is typically 0.37 mm and on the side close to the cutting blade 6' typically 0.30 mm. This geometry promotes hair penetration through the slits 8' of the cutting comb 5'.

FIG. 9 shows the pre-cutter 4' in a side view. Since in this illustration the feeding comb 10' is not mounted, the drive mechanism of the feeding comb 10' is exposed. The feeding comb 10' is driven by mechanical coupling to the cutting blade 6' which performs an oscillatory linear motion. For this purpose, the driving lever 18 has its one end connected to the body of the cutting blade 6' by means of a first joint 20. At its other end the driving lever 18 is secured to an end of the transmission lever 19 by means of a second joint 21. It is also possible for the joints 20 and 21 to be replaced with plastic hinges. The other end of the transmission lever 19 is suspended on the cutting comb 5' by means of a swivel axle 22 so that the transmission lever 19, driven by the driving lever 18, performs a swiveling motion about the swivel axle 22. Secured to the transmission lever 19 at a location between the second joint 21 and the swivel axle 22 is a drive axle 23 for the feeding comb 10'. As a result of this geometry, the amplitude of the motion transmitted via the drive axle 23 to the feeding comb 10' is the smaller the closer to the swivel axle 22 the drive axle 23 is arranged. In the embodiment shown, the amplitude of the motion of the cutting blade 6' is reduced by the transmission lever 19 to about one fifth, as a result of which the feeding comb 10' performs an oscillatory linear motion with the same frequency as the cutting blade 6', yet with a reduced amplitude. With an amplitude for the oscillatory motion of the cutting blade 6' of 2.2 mm related to the extreme displacements, there results for the feeding comb 10' an amplitude of 0.44 mm, equally related to the extreme displacements. To be able to perform this oscillatory motion, the feeding comb 10' has its two ends suspended on the casing part 2 in oscillatory manner. This is shown in FIG. 10.

FIG. 10 shows the feeding comb 10' in the area of one of its narrow ends in a perspective representation. The narrow end is constructed as a leaf spring 24 formed integrally with the feeding comb 10'. In the area of its free end the leaf spring 24 has a hole 25 suitable for insertion of, for example, a fastening screw for fastening the leaf spring 24 to the casing part 2.

Apart from the described application in the pre-cutter 4 or 4', there also exists the possibility for the feeding comb 10 or 10' to be used in another long-hair trimmer or some other component for the severing of hairs.

It will be understood that the above-described allocation of the features of the invention to the individual embodiments is not an absolute necessity. The features of different embodiments may also be used in combination. Accordingly, other embodiments are within the scope of the following claims.

What is claimed is:

1. A shear system for an electric hair removing apparatus comprising at least one shearing unit having an outer cutter and an undercutter that are set in relative motion, at least one feeding device arranged to precede the shearing unit, the feeding device being configured to be set in motion relative to the outer cutter and to perform an oscillatory motion; and a drive mechanism configured to drive the relative motion of the outer cutter and the undercutter;

wherein the amplitude of the oscillatory motion of the feeding device is smaller than the amplitude of the relative motion between the outer cutter and the undercutter, wherein the drive mechanism comprises a coupling mechanism that includes a driving lever and a transmission lever pivotally coupled to the driving lever, the driving lever being coupled to the undercutter and the transmission lever being suspended on the outer cutter, and wherein the drive mechanism further comprises a drive axle for the feeding device, secured to the transmission lever.

2. The shear system according to claim 1, characterized in that the feeding device includes plural feeding elements arranged in correlation with the geometry of the outer cutter.

3. The shear system according to claim 2, characterized in that the feeding elements of the feeding device are comprised of a plastics material at least in a region provided for contact with the area to be shaved.

4. The shear system according to claim 2, characterized in that the feeding elements of the feeding device are located laterally adjacent to the shearing unit.

5. The shear system according to claim 2, characterized in that the outer cutter includes bars and cutting apertures succeeding each other in alternation, and the feeding elements of the feeding device are arranged to precede the respective bars.

6. The shear system according to claim 5, characterized in that the bars are shaped in such manner that the cutting apertures widen from the side of the outer cutter where the undercutter is arranged toward a side opposite to said side of the outer cutter.

7. The shear system according to claim 5, characterized in that the bars enclose an angle with a cutting edge of the undercutter.

8. The shear system according to claim 5, characterized in that the feeding device is moved parallel to a direction in which the bars and the cutting apertures of the outer cutter succeed each other.

9. The shear system according to claim 1, characterized in that the feeding device is in abutting engagement with the shearing unit laterally only in some areas.

10. The shear system according to claim 1, characterized in that the frequency of the oscillatory motion of the feeding device corresponds to the frequency of the relative motion between the outer cutter and the undercutter.

11. The shear system according to claim 1, wherein the drive mechanism is configured to also drive the relative motion of the feeding device and the outer cutter.

12. The shear system according to claim 1, wherein the transmission lever is suspended on the outer cutter by a swivel axle.

13. The shear system according to claim 1, further comprising a coupling mechanism to transmit the relative motion between the outer cutter and the undercutter to the feeding device.

14. The shear system according to claim 1, characterized in that the feeding device is constructed in the form of a comb having its teeth oriented essentially perpendicular to a plane provided in the shearing unit for contact with the area to be shaved.

15. The shear system according to claim 14, characterized in that free ends of the teeth reach as far as to the plane provided for skin contact.

* * * * *

UNITED STATES PATENT AND TRADEMARK OFFICE

CERTIFICATE OF CORRECTION

PATENT NO. : 7,415,768 B2
APPLICATION NO. : 11/388500
DATED : August 26, 2008
INVENTOR(S) : Raoul Bader et al.

It is certified that error appears in the above-identified patent and that said Letters Patent is hereby corrected as shown below:

Title page, Item (73), Assignee:
Delete "Braum" and Insert --Braun--

Title page, Item (74), Attorney, Agent or Firm:
Delete "Richadson" and Insert --Richardson--

Signed and Sealed this

Eleventh Day of November, 2008

JON W. DUDAS
*Director of the United States Patent and Trademark Office*